US005114507A

United States Patent [19]

Piltz et al.

[11] Patent Number: 5,114,507

[45] Date of Patent: May 19, 1992

[54] CLOSURE DEVICE FOR A PACKAGING CONTAINER

[75] Inventors: Lars-Erik Piltz, Dalby; Stina Stenberg, Lund, both of Sweden

[73] Assignee: AB Akerlund & Rausing, Sweden

[21] Appl. No.: 651,426

[22] Filed: Feb. 6, 1991

Related U.S. Application Data

[60] Division of Ser. No. 414,740, Sep. 28, 1989, abandoned, which is a continuation of Ser. No. 309,076, Feb. 10, 1989, abandoned.

[30] Foreign Application Priority Data

Feb. 16, 1988 [SE] Sweden ..... 8800518

[51] Int. Cl.[5] ..... B29B 45/00

[52] U.S. Cl. ..... 156/69; 156/242; 156/245; 156/272.2; 156/274.4; 220/270

[58] Field of Search ..... 156/69, 242, 245, 272.2, 156/274.4; 220/257, 258, 270, 276

[56] References Cited

U.S. PATENT DOCUMENTS

| | | | |
|---|---|---|---|
| 3,549,440 | 12/1970 | Adcock | 156/272.4 |
| 4,548,333 | 10/1985 | Kobayashi et al. | 220/270 |
| 4,830,214 | 5/1989 | Curliss et al. | 220/270 |
| 4,867,336 | 9/1989 | Stewart | 156/69 |
| 4,913,306 | 4/1990 | Piltz | 220/270 |
| 4,913,307 | 4/1990 | Takata et al. | 156/69 |
| 4,966,301 | 10/1990 | Yamashita et al. | 220/270 |
| 5,013,828 | 5/1991 | Fries | 156/69 |

*Primary Examiner*—Caleb Weston

*Attorney, Agent, or Firm*—Lerner, David, Littenberg, Krumholz & Mentlik

[57] ABSTRACT

A cover device for a packaging container usable as a reclosable closure, comprising an outer layer provided with an easy opening device which has a grip and at least a tearing denotation extending circumferentially around the cover device. Additionally, the inner layer is attached to the outer layer at least at both sides of said tearing denotation.

The inner layer is covered only partially by the outer layer, leaving a central portion of the inner layer exposed to the environment.

A grip in the shape of a pull-ring is arranged in said central portion, and a strip-shaped connection portion connects the ring to a relatively narrow strip-shaped part of the outer layer, said part being removable together with the inner layer along a line defined by said circumferential tearing denotation. Of course, such tearing and removing facility necessitates that the tearing strength of the inner layer is lower than the weld strength and that the tearing denotation has a proper strength and is well-defined.

8 Claims, 2 Drawing Sheets

CLOSURE DEVICE FOR A PACKAGING CONTAINER

This is a division, of application Ser. No. 07/414,740, filed Sept. 28, 1989 which is a continuation of Ser. No. 07/309.076 filed Feb. 10, 1989 now abandoned.

FIELD OF THE INVENTION

The present invention relates to a closure device for a packaging container and more precisely a closure of the so called easy openable type where the closure also allows reclosing of the container without a substantial addition of costs.

BACKGROUND OF THE INVENTION

Frequently, there exists a problem of making a container closure having an exterior which looks rigid and strong, but which is easy-openable and, additionally, reclosable. Considering the fact that packaging containers and the closures thereof are extremely price-sensitive, it is realized that the problem by no means has an obvious solution.

PRIOR ART

The prior art within the actual field is full of various solutions of the easy-opening problem and to a certain degree also the problem of reclosing, but according to the knowledge of the applicant, so far, there has not been disclosed a closure structure which meets all three criteria just mentioned.

OBJECTS OF THE INVENTION

Thus, the object of the present invention is to provide a closure device meeting the stipulations and which additionally follows a more general structure philosophy developed together with this specific problem solution.

SUMMARY OF THE INVENTION

The present invention provides a closure device for a packaging container, comprising an outer layer having an easyopening device having a grip and at least a tearing denotation extending circumferentially around the closure device, and an inner layer attached to the outer layer at least at both sides of the tearing denotation.

The closure device is characterized in that the outer layer covers the inner layer only partially and leaves a central part having the inner layer exposed to the environment, that said grip has the shape of a pull-ring and is arranged at said central part, and that a connection portion interconnects the ring and a relatively seen narrow, ring shaped part of the outer layer, said part being removable together with the inner layer along a line defined by said circumferential tearing denotation.

In a preferred embodiment the connection portion is crossed by a further, short tearing denotation which merges with the said tearing denotation.

Preferably, the relatively narrow part of the outer layer merges into a rim diverging outwardly and defined by said first tearing denotation.

In one embodiment the rim has an enlarged upper edge against which a reclosable cover is demountably attachable.

Figure 1:
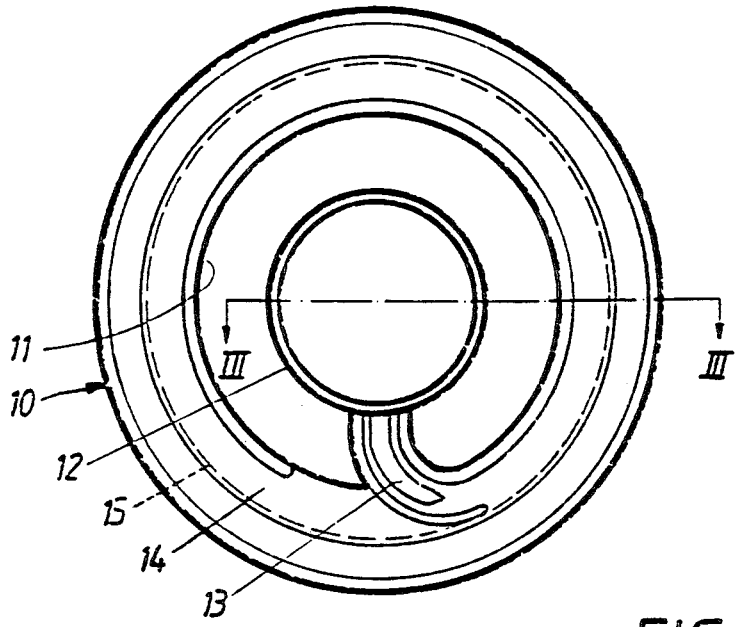
FIG. 1 shows from above an element forming an outer layer.

The element 10 in FIG. 1 is an integrally injection moulded element. As material may for instance polypropylene or other suitable thermoplastics material be used. The wall-thickness of the element 10 varies from one or some millimeters down to a tenth or few tenths of millimeter in the area of the tearing denotations. The technique for giving such tearing denotations the correct tearing strength by controlling the flow of material when injection moulding for avoiding stretching or orientation on the material crosswise the tearing denotations is described in a patent application filed simultaneously with the present one.

Figure 3:
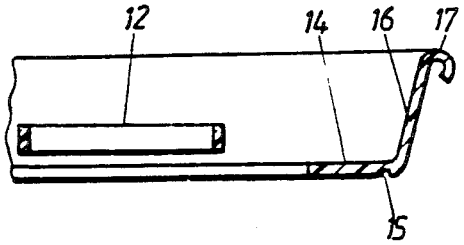
FIG. 3 is a section along line III—III in FIG. 1.
Figure 6:
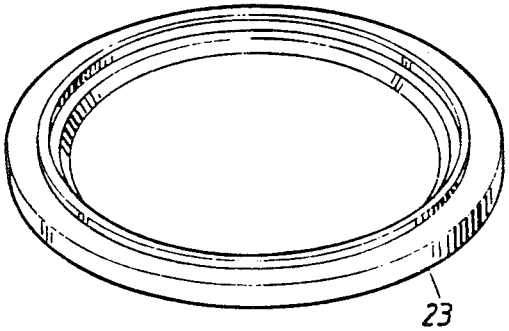
FIG. 6 shows a reclosable cover for the container in FIG. 5.
Figure 7:
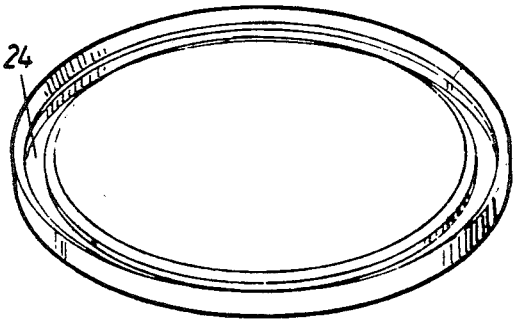
FIG. 7 shows the cover seen from below.

The amount of material and the structure and the design of the element 10 implies a product of cheap costs. Thus, centrally in the element 10 there is a relatively large, circular recess 11, in which a grip in the shape of a pull-ring 12 is arranged. Via a strip-shaped connection portion 13 the grip 12 is connected to a narrow, ring-shaped part 14 of the outer layer. This part 14 merges via a circumferential tearing denotation 15 into a circumferential outwardly diverging rim 16. The rim is terminated by a folded over short portion 17 which is intended for gripping the container mouth or a connection piece of a container, but also has a further specific function which will be mentioned with reference to FIGS. 5, 6 and 7. FIG. 3 indicates that the pull-ring 12 is located at a short distance above the plane of the circumferential part 14 meaning that the ring will be easy grippable.

Figure 4:
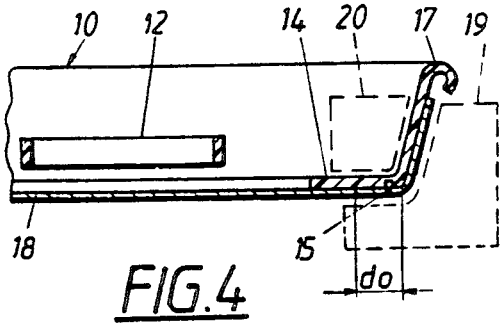
FIG. 4 schematically shows a partial section corresponding to FIG. 3 but where the element forming the outer layer is provided with an inner layer.

In FIG. 4 there is shown how a circular blank 18 of a flexible material, for instance plastics coated aluminium foil or other metal foil or a high barrier plastics material is attached against the element 10 for forming an inner layer. In FIG. 4 there is also shown the circumferential tearing denotation 19 and an area having a width $d_0$ defining the area in which the circular blank 18 is welded or attached in other manner against the closure formed by the elements 10 and 18. This type of attachment is required for obtaining the so called one step opening of the closure formed by the elements 10 and 18, by simply pulling the pull-ring 12 and tearing away the ring-shaped element 14 together with the membrane or circular blank 18 therebelow.

In order to provide such a limited, ring-shaped seal there is for instance used an arrangement of the type shown by broken lines in FIG. 4. An external conical support 19 acts as a support for the closure formed by the elements 10 and 18, and a circumferential welding jaw 20, for instance a high frequency welding jaw or an induction welding jaw, if this is possible taking in account the material at the welding area, is used for providing said attachment in the ring-shaped area or region having the width $d_0$.

Figure 2:
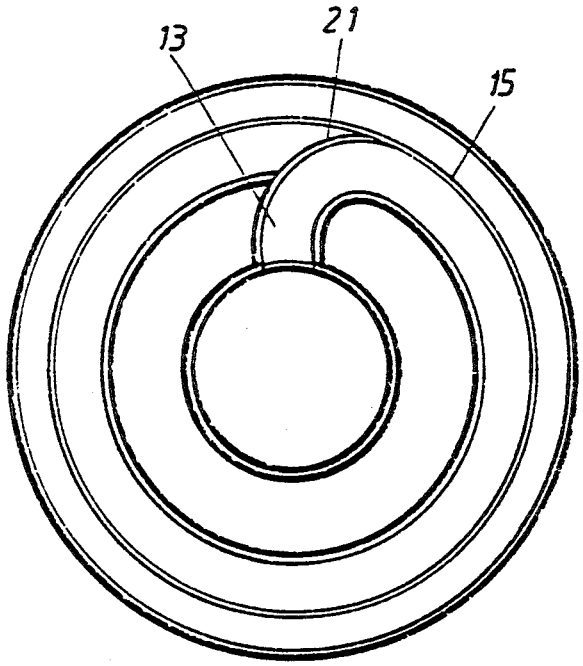
FIG. 2 shows the element seen from below.

As appears from for instance FIG. 2, the connection strip 13 has a further short tearing denotation 21 emerging from one side thereof and extending out to the circumferential tearing denotation 19.

Figure 5:
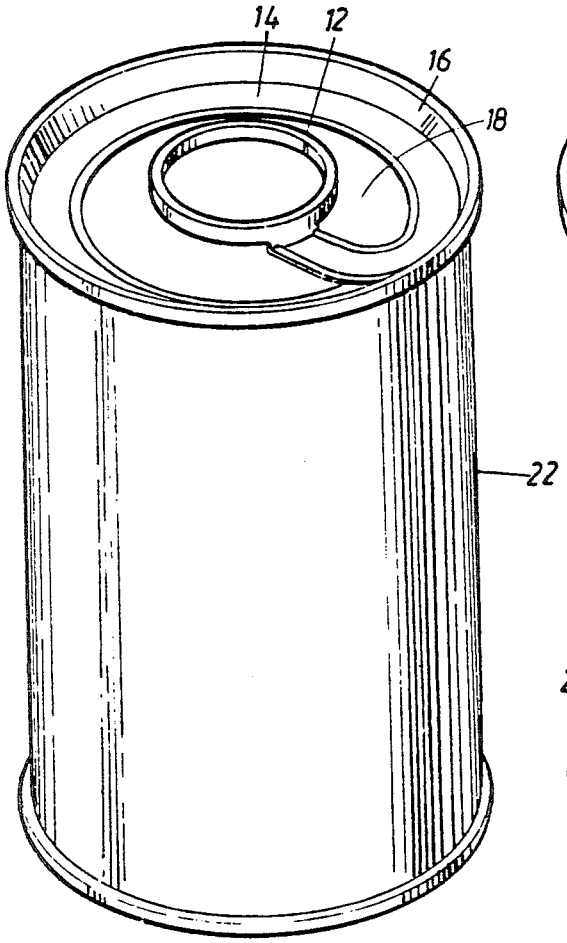
FIG. 5 shows a can-shaped container provided with an end closure according to FIG. 4.

In FIG. 5 there is shown how an end closure consisting of two layers according to FIG. 4 is mounted onto a can-shaped container 21. The attachment of the end closure to the container may be accomplished in different ways, for instance by use of the previously mentioned high frequency welding or induction welding. The technique for this is well developed, and as appears from FIG. 5 the can end has a somewhat outwardly diverging upper end region as a result of the conical rim 16. This is a prior art well-known method of providing a sealing pressure in the area between the inside of the can wall and the outside of the element 10 provided with the circular blank 18.

A simple plastics lid 22 or a lid of other suitable material is delivered together with the can 21 in FIG. 5, and the lid has the simplest possible design and is for instance provided with a circumferential groove 23 in the lower side thereof.

This groove has the function of attaching the cover by snap action onto the enlarged cover end edge 17.

Thus, there has been described a price worthy, technically simple and in practice fault free operating, so called one step cover, for a packaging container. As appears from the description, the end closure comprising the elements 10 and 18 may be used for providing extremely good characteristics both as to mechanical strength as barrier characteristics and therefor the structure is an attractive alternative to for instance metal covers or lids intended for as sophisticated packages as for instance retortable cans or other types of aseptic packages.

We claim:

1. A process for making a closure device for a packaging container comprising the steps of:

forming, by injection molding, an outer layer including an annular outer portion defining an outer periphery of said closure device and an easy-openable device integrally attached thereto, said easy-openable device having a grip in the shape of a pull ring and said easy-openable device and said annular outer portion being joined in the proximity of at least one tearing denotation extending circumferentially around said annular outer portion spaced inwardly from said outer periphery thereof, said outer layer including said annular outer portion and said integrally attached easy-openable device defining a central region having said grip arranged therein;

and welding an inner layer to both said annular outer portion and said integrally attached easy-openable device, said inner layer having a surface exposed to the environment through said central region.

2. The process of claim 1, including welding said inner layer to said outer layer by high frequency welding.

3. The process of claim 1, including welding said inner layer to said outer layer by induction welding.

4. The process of claim 1 including forming said easy-openable device to include a connection portion connected at a first end to said grip and connected at a second end to a narrow annular shaped member, whereby said member, said connection portion, and said grip are removable together with said inner layer, along a line defined by the circumferentially tearing denotation.

5. The process of claim 4 including forming a second short tearing denotation on said annular shaped member merging into said circumferential tearing denotation.

6. The process of claim 5 including forming said outer layer with an upper enlarged edge against which a reclosable cover is dismountably attached.

7. The process of claim 1, wherein said inner layer is selected from the group consisting of high barrier plastics and plastic coated metal foil.

8. The process of claim 1 wherein said outer layer is composed of a thermoplastic material.

* * * * *